US007654805B2

(12) United States Patent
Ishikawa

(10) Patent No.: US 7,654,805 B2
(45) Date of Patent: Feb. 2, 2010

(54) SCROLL COMPRESSOR WITH AN ANTI-ROTATION MECHANISM

(75) Inventor: Tatsuya Ishikawa, Anjo (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 11/715,372

(22) Filed: Mar. 8, 2007

(65) Prior Publication Data

US 2007/0231173 A1 Oct. 4, 2007

(30) Foreign Application Priority Data

Mar. 29, 2006 (JP) ..... 2006-089899

(51) Int. Cl.
*F01C 1/02* (2006.01)
*F01C 1/063* (2006.01)
*F03C 2/00* (2006.01)

(52) U.S. Cl. ..... 418/55.3; 418/55.1; 418/55.2

(58) Field of Classification Search ..... 418/55.1–55.5, 418/57; 464/102

See application file for complete search history.

(56) References Cited

U.S. PATENT DOCUMENTS 3,560,119 A * 2/1971 Busch et al. ..... 418/55.3
4,466,784 A * 8/1984 Hiraga ..... 418/55.1
4,795,323 A 1/1989 Lessie
5,098,265 A * 3/1992 Machida et al. ..... 418/55.3
5,591,022 A * 1/1997 Protos ..... 418/55.3
6,808,373 B2 * 10/2004 Suefuji et al. ..... 418/55.2

FOREIGN PATENT DOCUMENTS

JP 2002-227780 A 8/2002
JP 2004-003410 A 1/2004

* cited by examiner

*Primary Examiner*—Theresa Trieu
(74) *Attorney, Agent, or Firm*—Buchanan Ingersoll & Rooney PC

(57) ABSTRACT

A scroll compressor includes a fixed scroll, an orbiting scroll structuring an operation chamber for a fluid with the fixed scroll and compressing the fluid in the operation chamber by orbiting relative to the fixed scroll, a shaft having an eccentric portion connected to the orbiting scroll and receiving a driving force to rotate, a housing accommodating the orbiting scroll, the housing integrally provided with the fixed scroll, a tooth integrally formed at the orbiting scroll and extending in a radial direction of the orbiting scroll and an engaging portion integrally formed in the housing, the engaging portion facing the tooth in the radial direction of the orbiting scroll and engaging with the tooth in a circumferential direction of the orbiting scroll.

9 Claims, 3 Drawing Sheets

FIG.3A FIG.3B FIG.3C FIG.3D
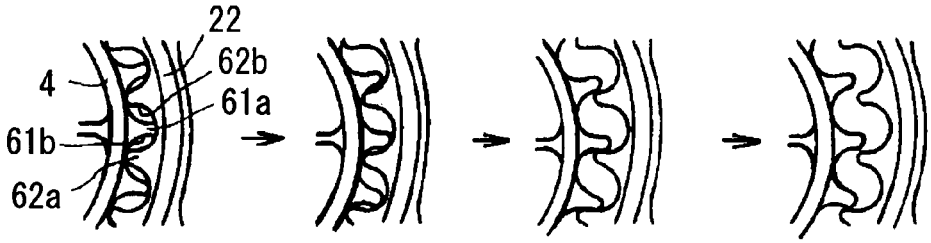
FIG.3E FIG.3F FIG.3G FIG.3H
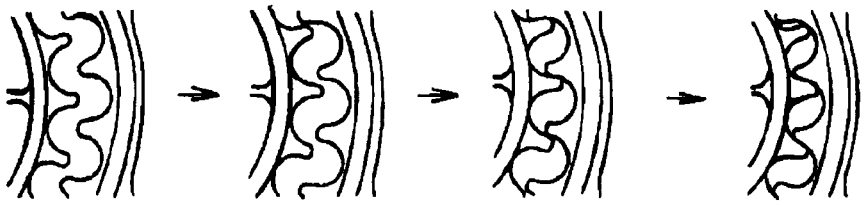
FIG.3A
F I G. 4
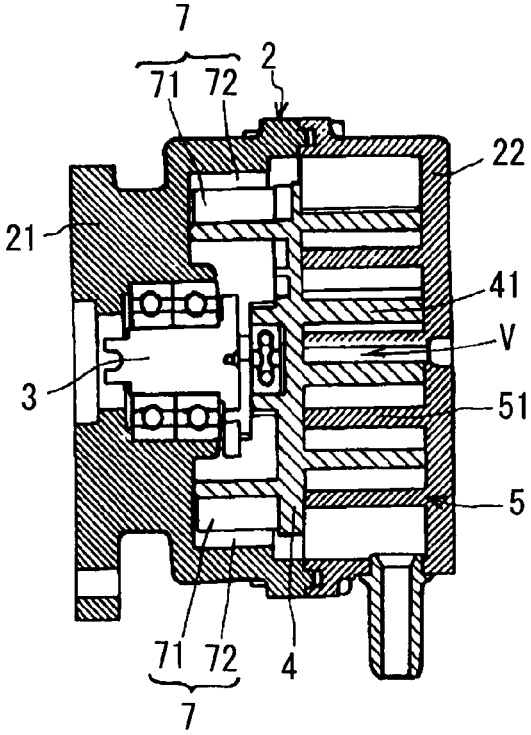

SCROLL COMPRESSOR WITH AN ANTI-ROTATION MECHANISM

CROSS REFERENCE TO RELATED APPLICATIONS

This application is based on and claims priority under 35 U.S.C § 119 with respect to Japanese Patent Application 2006-089899, filed on Mar. 29, 2006, the entire content of which is incorporated herein by reference.

FIELD OF THE INVENTION

This invention relates to a scroll compressor.

BACKGROUND

A known scroll compressor is disclosed in the below-mentioned JP2002-227780A. The compressor includes a fixed scroll, an orbiting scroll. The orbiting scroll constructs an operation chamber with the fixed scroll and compresses a fluid in the operation chamber by orbiting relative to the fixed scroll. The compressor further includes a shaft and a housing supporting the shaft. The shaft has an eccentric portion which connects to the orbiting scroll and receives a driving force to rotate. Further, a mechanism is provided at the compressor to prevent the rotation of the orbiting scroll caused by a reaction force generated in fluid compression. The mechanism is disposed between the housing and the orbiting scroll relative to an axial direction of the compressor and composed of a ring-shaped component and a roller. The rotation of the orbiting scroll is restricted relative to the ring-shaped component and the rotation of the ring-shaped component is restricted relative to the housing.

The mechanism for preventing the rotation of the orbiting scroll is composed of the ring-shaped component and the roller in the aforementioned scroll compressor. Therefore, the number of the components increases resulting in the complicated structure.

The present invention has been made in view of the above circumstances, and provides a scroll compressor enabling simplification of the structure.

SUMMARY OF THE INVENTION

According to an aspect of the present invention, a scroll compressor includes a fixed scroll, an orbiting scroll constructing an operation chamber for a fluid with the fixed scroll and compressing the fluid in the operation chamber by orbiting relative to the fixed scroll, a shaft having an eccentric portion connected to the orbiting scroll and receiving a driving force to rotate, a housing accommodating the orbiting scroll, the housing integrally provided with the fixed scroll, a tooth integrally formed at the orbiting scroll and extending in a radial direction of the orbiting scroll, and an engaging portion integrally formed in the housing, the engaging portion facing the tooth in the radial direction of the orbiting scroll and engaging with the tooth in a circumferential direction of the orbiting scroll.

BRIEF DESCRIPTION OF THE DRAWINGS

The foregoing and additional features and characteristics of the present invention will become more apparent from the following detailed description considered with reference to the accompanying drawings, wherein:

FIG. 3 is a view schematically illustrating operation of an anti-rotation mechanism 6;

FIG. 4 is a view illustrating a second embodiment (anti-rotation mechanism 7) of the present invention.

DETAILED DESCRIPTION

Embodiments of the present invention will be described below with reference to the attached drawings.

Figure 1:
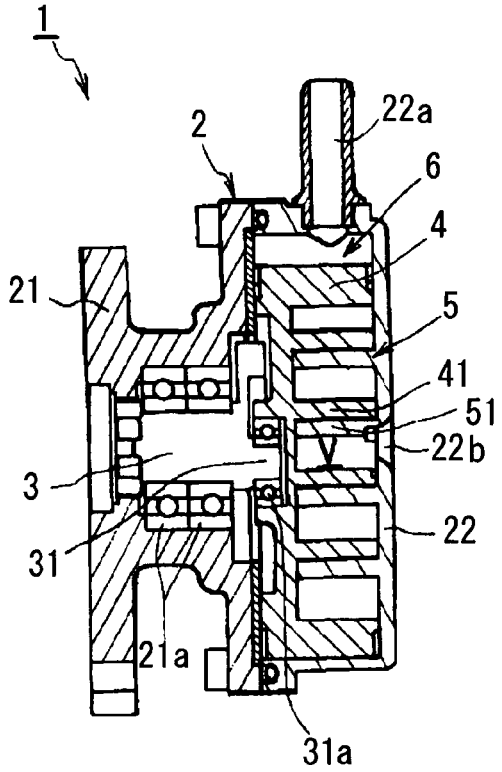
FIG. 1 is a view illustrating a structure of a scroll compressor 1 according to a first embodiment of the present invention.

FIG. 1 is a view illustrating a structure of a scroll compressor 1 according to a first embodiment of the present invention. The scroll compressor 1 is provided with a housing 2, a shaft 3, an orbiting scroll 4 and a fixed scroll 5.

The housing 2 is constructed by a front housing 21 and a rear housing 22. The front housing 21 is formed by a resin material or the likes and rotatably supports the shaft 3 via bearings 21*a*. The rear housing 22 is a bottomed cylindrical shape and is connected to the front housing 21. The rear housing 22 accommodates the orbiting scroll 4 and the fixed scroll 5 with the front housing 21. The rear housing 22 is provided with an intake port 22*a* and a discharge port 22*b* for the fluid. The shaft 3 receives a driving force from a driving means such as a motor (not shown) to rotate. The shaft 3 is provided with an eccentric portion 31. The eccentric portion 31 is formed to be eccentrically positioned in a radial outward direction relative to a rotational center of the shaft 3. The shaft 3 is connected to the orbiting scroll 4 with the eccentric portion 31 via bearings 31*a*. The orbiting scroll 4 is a circular member and is provided with a spiral-shaped wrap 41 extending toward the rear housing 22. The orbiting scroll 4 is formed by a resin material or the likes. The orbiting scroll 4 faces the fixed scroll 5 with respect to an axial direction of the scroll compressor 1 (horizontal direction in FIG. 1). The fixed scroll 5 is integrally provided in the rear housing 22. The fixed scroll 5 is integrally formed by a resin material and the likes together with the rear housing 22. The fixed scroll 5 is provided with a spiral-shaped wrap 51 extending toward the front housing 21. The wrap 51 of the fixed scroll 5 comes in contact with the wrap 41 of the orbiting scroll 4 to construct operation chambers V when the fixed scroll 5 and the orbiting scroll 4 are assembled. In other words, the wrap 51 of the fixed scroll 5 constructs the operation chambers V for the fluid with the wrap 41 of the orbiting scroll 4 therebetween.

When the shaft 3 rotates, the eccentric portion 31 of the shaft 3 eccentrically rotates around a central axis of the shaft 3 (circular motion). When the eccentric portion 31 of the shaft 3 eccentrically rotates, the orbiting scroll 4 connected to the eccentric portion 31 orbits relative to the fixed scroll 5. In response to the movement, volumes of the operation chambers V sequentially change, and the fluid suctioned from the intake port 22*a* of the rear housing 22 is discharged to outside of the compressor via the discharge port 22*b* after being compressed in the operation chambers V.

Meanwhile, when the fluid is compressed in the operation chambers V, the orbiting scroll 4 receives a force (force attempting to rotate the orbiting scroll 4) around its center by a reaction force generated by fluid compression. The scroll compressor 1 of the embodiment of the present invention is provided with an anti-rotation mechanism 6 for preventing rotation of the orbiting scroll 4. The anti-rotation mechanism 6 will be described below with reference to FIGS. 2 and 3.

Figure 2:
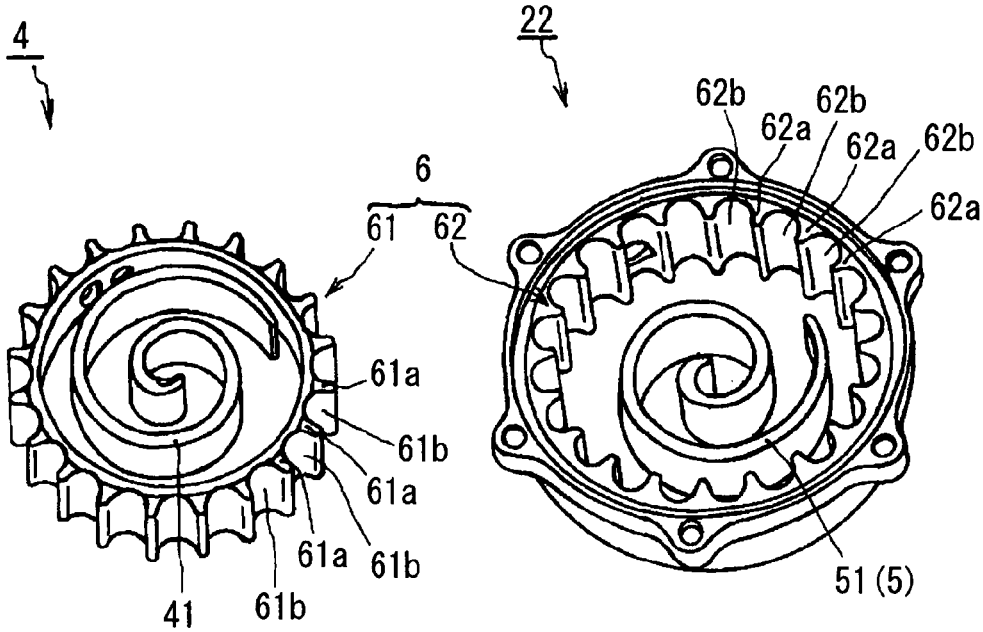
FIG. 2 is a perspective view of an orbiting scroll 4 and a rear housing 22 (fixed scroll 5)

FIG. 2 is a perspective view of the orbiting scroll 4 and the rear housing 22 (fixed scroll 5). The anti-rotation mechanism 6 according to the embodiment of the present invention is provided between the orbiting scroll 4 and the rear housing 22. The anti-rotation mechanism 6 is constructed by teeth 61 integrally formed in the orbiting scroll 4 and engaging portions 62 integrally formed in the rear housing 22. These teeth 61 and the engaging portions 62 are integrally formed in the orbiting scroll 4 and the rear housing 22 respectively, by resin materials or the likes.

The teeth 61 constitute a first gear portion and are integrally formed on an outer circumference of the orbiting scroll 4. The teeth 61 are provided so as to surround the wrap 41 of the orbiting scroll 4 and each tooth 61 is composed of a mountain-shaped portion 61*a* and a sliding contact surface 61*b*. (reference numerals only indicate for three teeth in FIG. 2). Each mountain-shaped portion 61*a* extends in a radial outward direction of the orbiting scroll 4. Plural mountain-shaped portions 61*a* are provided along the outer circumference of the orbiting scroll 4 having a space between each other relative to a circumferential direction of the orbiting scroll 4. By virtue of the mountain-shaped portions 61*a*, each tooth 61 of the first gear portion has a first circular arc convex surface as shown in FIGS. 2 and 3A-3H. Each sliding contact surface 61*b* is provided between the respective mountain-shaped portions 61*a* and connects the mountain-shaped portion 61*a* to the adjacent mountain-shaped portion 61*a*. Each sliding contact surface 61*b* forms a circular arc from the top of the mountain-shaped portion 61*a* toward the top of the adjacent mountain-shaped portion 61*a*. By virtue of the contact surface 61*b*, the first gear portion comprises a circular arc concave surface between adjacent teeth 61 as shown in FIGS. 2 and 3A-3H.

The engaging portions 62 are integrally formed around the fixed scroll 5 (wrap 51) of the rear housing 22. The engaging portions 62 are teeth constituting a second gear portion. The engaging portions 62 are provided so as to surround the wrap 51 of the fixed scroll 5. The engaging portions 62 face the teeth 61 of the orbiting scroll 4 relative to the radial direction of the orbiting scroll 4 when the orbiting scroll 4 and the fixed scroll 5 are assembled. The engaging portions 62 engage with the teeth 61 of the orbiting scroll 4 relative to the circumferential direction of the orbiting scroll 4. Each engaging portion 62, similarly to the tooth 61, is composed of a mountain-shaped portion 62*a* and a sliding contact surface 62*b* (reference numerals only indicate three teeth in FIG. 2). Each mountain-shaped portion 62*a* extends in a radial inward direction of the fixed scroll 5 (rear housing 22). Plural mountain-shaped portions 62*a* are provided along an inner circumference of the rear housing 22 having a space between each other relative to a circumferential direction of the fixed scroll 5 (rear housing 22). By virtue of the mountain-shaped portions 62*a*, each engaging portion or tooth 62 of the second gear portion has a second circular arc convex surface as shown in FIGS. 2 and 3A-3H. Each sliding contact surface 62*b* is provided between the respective mountain-shaped portions 62*a* and connects the mountain-shaped portion 62*a* to the adjacent mountain-shaped portion 62*a*. Each sliding contact surface 62*b* forms a circular arc from the top of the mountain-shaped portion 62*a* toward the top of the adjacent mountain-shaped portion 62*a*. By virtue of the contact surface 62*b*, the second gear portion comprises a circular arc concave surface between adjacent teeth or engaging portions 62 as shown in FIGS. 2 and 3A-3H.

Next, operation of the anti-rotation mechanism 6 will be described with reference to FIG. 3. FIG. 3 is a view schematically illustrating the operation of the anti-rotation mechanism 6.

When the shaft 3 rotates, the orbiting scroll 4 connected to the eccentric portion 31 of the shaft 3 orbits (circular motion) relative to the fixed scroll 5. While the orbiting scroll 4 is orbiting, the mountain-shaped portions 61*a* of the teeth 61 in the orbiting scroll 4 engage with the mountain-shaped portions 62*a* of the engaging portions 62 in the rear housing 22 relative to the circumferential direction of the orbiting scroll 4 (i.e. direction of the rotation) to prevent the rotation of the orbiting scroll 4.

As illustrated in FIGS. 3A to 3H, when the orbiting scroll 4 orbits, the mountain-shaped portions 61*a* of the teeth 61 in the orbiting scroll 4 slidably contact with the sliding contact surfaces 62*b* of the engaging portions 62 in the rear housing 22. Concurrently, the mountain-shaped portions 62*a* of the engaging portions 62 in the rear housing 22 slidably contact with the sliding contact surfaces 61*b* of the teeth 61 in the orbiting scroll 4. Each sliding contact surface 61*b* of the teeth 61 and each sliding contact surface 62*b* of the engaging portions 62 are formed in the circular arcs. Hence, the mountain-shaped portions 61*a* of the orbiting scroll 4 are smoothly guided along the sliding contact surfaces 62*b* of the rear housing 22 and the mountain-shaped portions 62*a* of the rear housing 22 are smoothly guided along the sliding contact surfaces 61*b* of the orbiting scroll 4. Thus, the teeth 61 of the orbiting scroll 4 smoothly engage with the engaging portions 62 of the rear housing 22 relative to the circumferential direction of the orbiting scroll 4 and the movement of the orbiting scroll 4 (orbiting movement) is stabilized.

Figure 5:
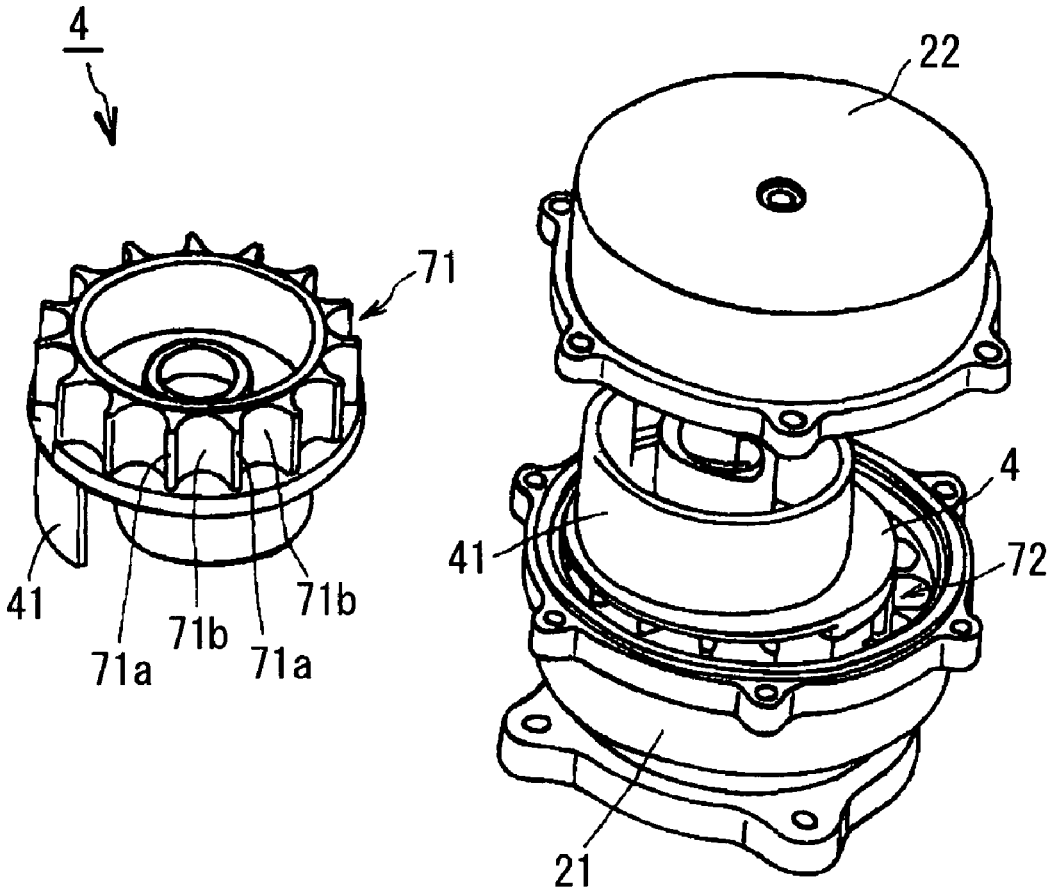
FIG. 5 is a view illustrating the second embodiment (anti-rotation mechanism 7) of the present invention.

Meanwhile, in the above description, the teeth 61 and the engaging portions 62, of the anti-rotation mechanism 6, are formed on the outer circumference of the wrap 41 of the orbiting scroll 4 and in the rear housing 22 respectively. However, the form is not limited to this configuration. For example, as illustrated in FIGS. 4 and 5, the compressor may be configured in a way that teeth 71 are formed in a front portion of the orbiting scroll 4 in the axial direction (illustrated in the left portion of FIG. 4) and engaging portions 72 are formed in the front housing 21 (second embodiment). The teeth 71 face the engaging portions 72 relative to the radial direction of the orbiting scroll 4 and engage with the engaging portions 72 relative to the circumferential direction of the orbiting scroll 4. Each tooth 71, similarly to the tooth 61 of the anti-rotation mechanism 6, is composed of a mountain-shaped portion 71*a* and a sliding contact surface 71*b*. Each engaging portion 72 has a similar configuration to that of the engaging portion 62 of the anti-rotation mechanism 6. The description of operation of an anti-rotation mechanism 7, which is composed of the teeth 71 and the engaging portions 72, is omitted because the operation of the anti-rotation mechanism 7 is identical to that of the anti-rotation mechanism 6. Out of the reference numerals shown in FIGS. 4 and 5, the reference numerals which are identical to those shown in FIGS. 1 to 3, designate the members corresponding to the reference numerals shown in FIGS. 1 to 3.

As described above, the scroll compressor 1, according to the embodiment of the invention, is provided with the teeth 61 and the engaging portions 62. The teeth 61 are integrally formed at the orbiting scroll 4 and extend in the radial direction of the orbiting scroll 4. The engaging portions 62 are integrally provided in the rear housing 22 and face the teeth 61 relative to the radial direction of the orbiting scroll 4. The engaging portions 62 of the rear housing 22 engage with the teeth 61 of the orbiting scroll 4 relative to the circumferential direction of the orbiting scroll 4. According to the configuration, the rotation of the orbiting scroll 4 is restricted by the teeth 61 of the orbiting scroll 4 and the engaging portions 62 of the rear housing 22. The teeth 61 and the engaging portions 62 are integrally formed with the orbiting scroll 4 and the rear housing 22 respectively. Thus, it is not necessary to provide additional components to configurate the mechanism for preventing the rotation of the orbiting scroll 4. As described above, according to the scroll compressor 1 of the embodiment of the invention, it is possible to reduce the number of the components resulting in the simplification of the configuration.

Further, when the orbiting scroll 4 orbits, the mountain-shaped portions 62*a* of the engaging portions 62 of the rear housing 22 are smoothly guided by the sliding contact surfaces 61*b* of the teeth 61 of the orbiting scroll 4. Thus, the orbiting movement of the orbiting scroll 4 is stabilized and the scroll compressor 1 smoothly operates.

Furthermore, when the orbiting scroll 4 orbits, the mountain-shaped portions 61*a* of the teeth 61 of the orbiting scroll 4 are smoothly guided by the sliding contact surfaces 62*b* of the engaging portions 62 of the rear housing 22. Thus, the orbiting movement of the orbiting scroll 4 is stabilized and the scroll compressor 1 smoothly operates.

In the first embodiment of the present invention, the engaging portions 62 are formed in the rear housing 22 so as to surround the fixed scroll 5 (wrap 51) and the teeth 61 are formed on the outer circumference of the orbiting scroll 4. According to the configuration, the mechanism for preventing the rotation of the orbiting scroll 4 (anti-rotation mechanism 6) is disposed within a space where the wrap 41 of the orbiting scroll 4 and the wrap 51 of the fixed scroll 5 occupy in the axial direction of the scroll compressor 1. Therefore, it is possible to reduce the size of the scroll compressor 1 in the axial direction.

According to the embodiment of the invention, the scroll compressor includes the teeth which are integrally formed at the orbiting scroll and extends in the radial direction of the orbiting scroll and the engaging portions which are integrally provided with the housing and face the teeth relative to the radial direction of the orbiting scroll. The engaging portions of the housing engage with the teeth of the orbiting scroll relative to the circumferential direction of the orbiting scroll. According to the configuration described above, the rotation of the orbiting scroll is restricted by the teeth of the orbiting scroll and the engaging portions of the housing. Since the teeth and the engaging portions are integrally formed with the orbiting scroll and the housing respectively, it is not necessary to provide additional components to configure the mechanism for preventing the rotation of the orbit scroll. Thus, according to the embodiment of the invention, it is possible to reduce the number of the components and simplify the configuration.

According to the embodiment of the invention, the engaging portions of the housing are smoothly guided by the first circular arcs of the teeth of the orbiting scroll when the orbiting scroll orbits.

According to the embodiment of the invention, the teeth of the orbiting scroll are smoothly guided by the second circular arcs of the engaging portions of the housing when the orbiting scroll orbits.

According to the embodiment of the invention, the engaging portions are formed around the fixed scroll in the first housing and the teeth are formed around the orbiting scroll. According to the configuration, the mechanism for preventing the rotation of the orbiting scroll is disposed within the space that the orbiting scroll and the fixed scroll occupy in the axial direction. Therefore, it is possible to reduce the size of the compressor in the axial direction.

The principles, of the preferred embodiments and mode of operation of the present invention have been described in the foregoing specification. However, the invention, which is intended to be protected, is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A scroll compressor comprising:

a fixed scroll;

an orbiting scroll constructing an operation chamber for a fluid with the fixed scroll and compressing the fluid in the operation chamber by orbiting relative to the fixed scroll;

a shaft having an eccentric portion connected to the orbiting scroll and receiving a driving force to rotate;

a housing accommodating the orbiting scroll, the housing integrally provided with the fixed scroll; and an anti-rotation mechanism for preventing rotation of the orbiting scroll, the anti-rotation mechanism comprising:

a first gear portion comprising a plurality of teeth integrally formed at the orbiting scroll and extending in a radial direction of the orbiting scroll, each tooth of the first gear portion having a first circular arc convex surface;

the first gear portion comprising a first circular arc concave surface between two adjacent teeth;

a second gear portion comprising a plurality of teeth integrally formed on an inner periphery of the housing, each tooth of the second gear portion having a second circular arc convex surface, the second gear portion facing the first gear portion in the radial direction of the orbiting scroll and engaging with the first gear portion in a circumferential direction of the orbiting scroll, the second gear portion comprising a second circular arc concave surface between two adjacent teeth of the second gear portion; and the first circular arc convex surface being in sliding engagement with the second circular arc concave surface, and the first circular arc concave surface being in sliding engagement with the second circular arc convex surface.

2. A scroll compressor according to claim 1, wherein the housing is composed of a first housing at which the fixed scroll is provided and a second housing which supports the shaft and accommodates the orbiting scroll with the first housing, wherein the engaging portion is formed around the fixed scroll of the first housing and the tooth is formed around the orbiting scroll.

3. A scroll compressor according to claim 1, wherein the housing is composed of a first housing at which the fixed scroll is integrally provided and a second housing which supports the shaft and accommodates the orbiting scroll with the first housing, wherein the engaging portion is formed in the second housing and the tooth is formed so as to face the engaging portion relative to the radial direction of the orbiting scroll.

4. A scroll compressor according to claim 1, wherein the at least one of orbiting scroll and fixed scroll includes a spiral shaped wrap.

5. A scroll compressor according to claim 4, wherein the orbiting scroll and fixed scroll each include a spiral shaped wrap, the spiral shaped wrap of the fixed scroll and the spiral shaped wrap of the orbiting scroll forming the operation chamber.

6. A scroll compressor according to claim 1, wherein the tooth is integrally formed on an outer circumference of the orbiting scroll.

7. A scroll compressor according to claim 1, wherein the engaging portion is integrally formed along an inner circumference in the housing.

8. A scroll compressor according to claim 1, wherein the tooth is integrally formed on an outer circumference of the orbiting scroll and the engaging portion is integrally formed along an inner circumference in the housing.

9. A scroll compressor according to claim 1, wherein at least one of the orbiting scroll and fixed scroll includes a spiral shaped wrap;

the tooth is integrally formed on an outer circumference of the orbiting scroll; and the engaging portion is integrally formed along an inner circumference of the housing.

* * * * *